US006444939B1

(12) United States Patent
Crookston et al.

(10) Patent No.: US 6,444,939 B1
(45) Date of Patent: Sep. 3, 2002

(54) VACUUM SWITCH OPERATING MECHANISM INCLUDING LAMINATED FLEXIBLE SHUNT CONNECTOR

(75) Inventors: Ronald W. Crookston, Trafford; John J. Hoegle, Beaver; Paul T. Bottegal, Lower Burrell; Walter O. Jenkins, Crafton; Francois J. Marchand, Pittsburgh, all of PA (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 09/567,263

(22) Filed: May 9, 2000

(51) Int. Cl.[7] ..... H01H 33/66
(52) U.S. Cl. ..... 218/140; 218/120; 218/154
(58) Field of Search ..... 200/118–120, 140, 200/154

(56) References Cited

U.S. PATENT DOCUMENTS 3,166,658 A * 1/1965 Jennings ..... 218/138
4,216,359 A * 8/1980 Hruda ..... 218/118
4,376,235 A 3/1983 Milianowicz
4,384,179 A 5/1983 Milianowicz
4,527,028 A * 7/1985 Luehring ..... 218/119
5,486,662 A 1/1996 Takiishi
5,530,216 A 6/1996 Benke et al.

* cited by examiner

*Primary Examiner*—J. R. Scott
(74) *Attorney, Agent, or Firm*—Martin J. Moran

(57) ABSTRACT

A flexible shunt in the form of a flexible member made up of a stack of electrically conductive laminations each of a thickness of no more than about 0.002 inch (0.051 mm) has a moveable end secured by a moveable mount to a moveable contact support of an electric power switch for movement along a linear path. A fixed mount secures the fixed end of the flexible member to a fixed conductor termination spaced laterally from the moveable end along a neutral axis perpendicular to the linear path of the moveable end by an offset distance such that the installed length of the intermediate section between the fixed and moveable ends is less than the free length of the intermediate section. With this arrangement the stroke of the moveable end along the linear path can be up to at least ⅓ and even ½ of the free length of the intermediate section of the flexible member and with very low operating forces.

28 Claims, 2 Drawing Sheets

VACUUM SWITCH OPERATING MECHANISM INCLUDING LAMINATED FLEXIBLE SHUNT CONNECTOR

BACKGROUND OF THE INVENTION

1. Field of the Invention

This invention relates to flexible connections for conducting load current in electric power switches between a moveable contact support and a fixed conductor.

2. Background Information

Electric power switches require an arrangement for conducting the load current between a moveable contact of the switch and a fixed conductor. The requirements for such an arrangement are many and include such things as: adequate current carrying capability, adequate motion capacity and directional ability, minimum force/energy requirements, temperature withstand ability, ability to retain shape or integrity under transient conditions, and others. While some electric power switches utilize sliding connectors for this purpose, the most common connection is a flexible conductor or shunt.

In electric power switches with lower current ratings, a braided copper conductor is often used as the flexible shunt. At higher current ratings, such as in medium voltage circuit breakers, it is known to utilize a flexible conductor made up of a stack of thin copper laminations. These laminations have been at least 0.003 inches (0.076 mm), and in some cases as much as 0.040 inches (1.016 mm), thick. The laminated conductors to date have been relatively long compared to the stroke, that is the movement required to open and close the switch. They have also required an appreciable force to operate. In some applications, the laminated shunt is installed in a C configuration which requires a long conductor and takes considerable space in two dimensions. In another arrangement, a V fold is provided in the laminated shunt. This latter arrangement is very effective, but again, requires a long shunt and considerable space in two dimensions.

With the trend toward more compact electric power switches with higher current ratings, an improved flexible shunt is needed. The currently available flexible conductors or shunts have been found to be either too large, too expensive, not reliable enough or require too much force to operate, or to have combinations of these limitations.

SUMMARY OF THE INVENTION

This invention is directed to an improved flexible shunt for electrically connecting an electric power switch moveable contact support member reciprocating along a linear path to a stationary termination positioned laterally of the linear path. This flexible shunt includes a flexible member comprising a stack of electrically conductive laminations having an intermediate section of predetermined length between a fixed end and the moveable end. A moveable mount secures the moveable end of the flexible member to the moveable contact support member for movement over a stroke extending along the linear path between a closed position at one end of the stroke and an open position at the other end of the stroke. A fixed mount secures the fixed end of the flexible member to the stationary conductor termination with the fixed end spaced from the moveable end along a neutral axis which is substantially perpendicular to the linear path of the moveable contact support by an offset distance which is less than the predetermined length of the intermediate section. The stroke of the moveable contact member is at least about one-third of the predetermined length of the intermediate section and can be at least about one-half the length of the intermediate section. Preferably, the fixed mount and the moveable mount mount the respective ends of the flexible member with the laminations extending substantially perpendicular to the linear path. The laminations can be joined together at the ends, or alternatively, can be plated to reduce the interface resistance between laminations.

The laminations of the flexible member of the invention are very thin. More particularly, the laminations are no greater than about 0.002 inches (about 0.051 mm) thick and preferably no more than about 0.0015 inches (about 0.038 mm) thick. Depending upon the ampacity required, the flexible member can have at least about 100 laminations and in some applications at least about 200 laminations.

The flexible shunt of the invention is particularly suitable for use with vacuum interrupters. Such interrupters can have a stroke, including tolerances and wear, of at least about 0.6 inches (about 15 mm) and even at least about 0.787 inches (about 20 mm). Thus the moveable end of the flexible member must be capable of reciprocating along the linear path at least these distances. Even with the stroke of about 0.787 inches (about 20 mm) the length of the intermediate section of the flexible member need be no more than about 1.5 inches (about 38.1 mm).

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
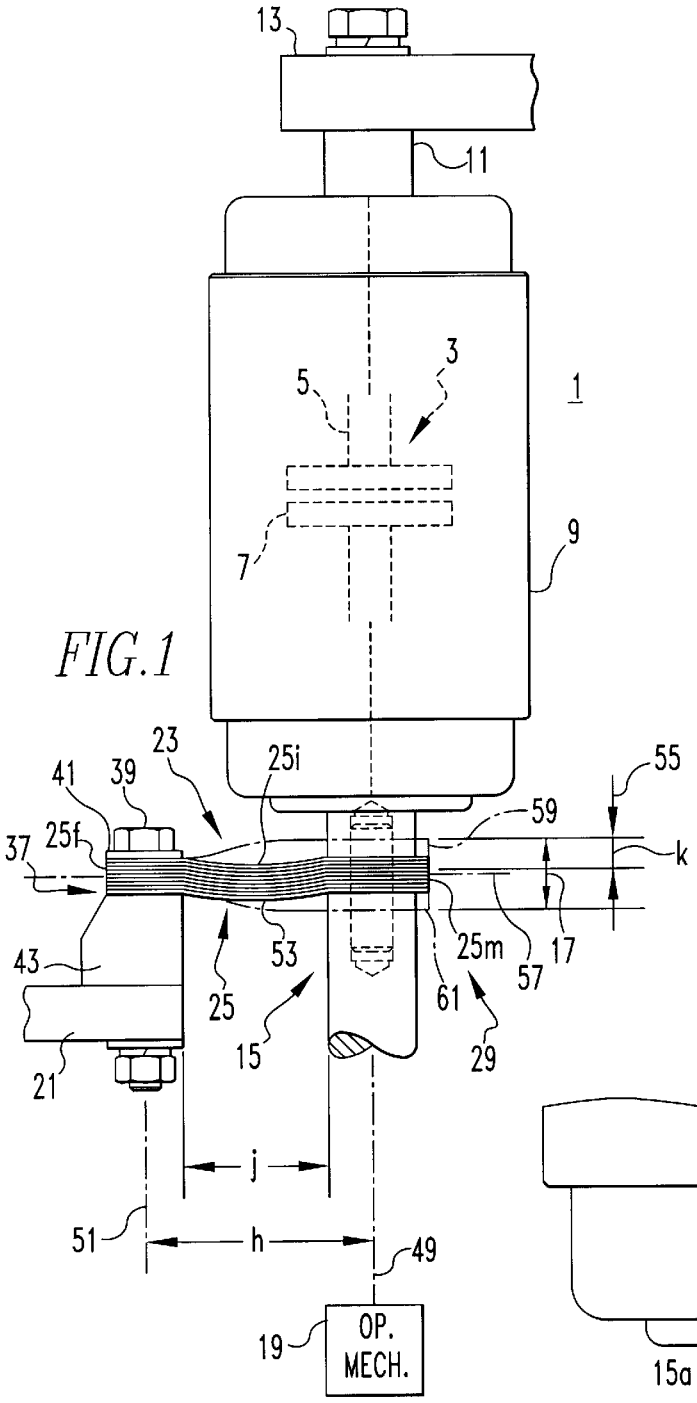
FIG. 1 is a partially schematic elevational view of a vacuum interrupter in accordance with the invention.
Figure 2:
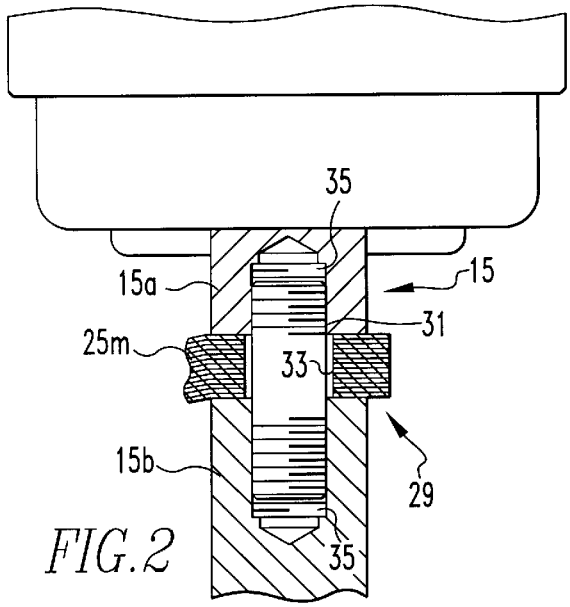
FIG. 2 is a fragmentary view of a section of FIG. 1 in enlarged scale.

The present invention is directed to a flexible shunt for an electric power switch and an electric power switch incorporating such a flexible shunt. The invention is particularly suitable for application to medium voltage vacuum interrupters but can also be applied to other types and sizes of electric power switches.

Hence, the invention will be described as applied to an electric power switch in the form of a vacuum interrupter 1 shown in FIG. 1. Such a vacuum interrupter 1 has a set of separable contacts 3 including a fixed contact 5 and a moveable contact 7 housed in a vacuum bottle 9. The fixed contact 5 is mounted on a fixed contact stem 11 extending out of the top of the vacuum bottle 9 and bolted to a fixed conductor 13. The moveable contact 7 is carried by a moveable contact stem 15 which is reciprocated along a linear path 17 by an operating mechanism shown schematically at 19 to open and close the separable contacts 3. The moveable contact stem 15 is electrically connected to a fixed conductor termination 21 by a flexible shunt 23.

The flexible shunt 23 includes a flexible member 25 having a fixed end **25*f*, a moveable end 25*m* and an intermediate section 25***i* between the fixed and moveable ends. The flexible member 25 is made of a stack of thin laminations 27 to be more fully described. The moveable end 25*m* of the flexible member 25 is secured to the moveable contact stem 15 by a moveable mount 29. This moveable mount 29 is formed by two sections 15*a* and 15*b* of the moveable contact stem 15. A terminal stud 31 which extends through an aperture 33 in the moveable end 25*m* of the flexible member is threaded into tapped holes 35 in the ends of both sections 15*a* and 15*b* of the moveable contact stem. Tightening of this connection clamps the moveable end 25*m* of the flexible member 25 between the two sections of the moveable contact stem 15.

The fixed end 25*f* of the flexible member 25 is secured to the fixed conductor termination 21 by a fixed mount 37. This fixed mount 37 includes a pair of bolts 39 (only one shown in FIG. 1) extending through the fixed end 25*f* and the fixed conductor termination 21. A pressure plate 41 extends across the top of the fixed end 25*f* to apply the clamping force entirely over the fixed end 25*f*. In the exemplary vacuum interrupter, a support block 43 provides the proper positioning of the fixed end 25*f* relative to the fixed conductor termination 21 and the location of the moveable mount 37. The need for and dimensions of this support block 43 are dependent upon the particular installation.

Figure 3:
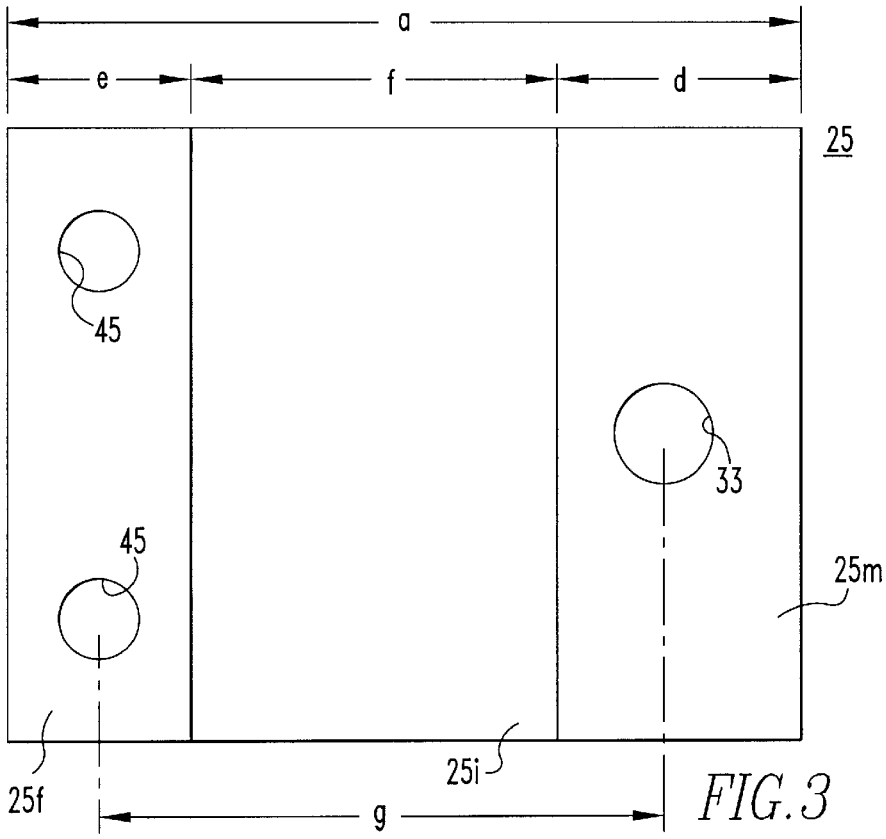
FIG. 3 is a plane view of a flexible member which is a component of the invention.
Figure 4:
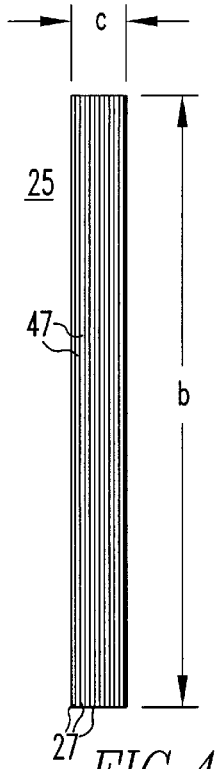
FIG. 4 is an end view of the flexible member of FIG. 3.

The flexible member 25 is shown in plane view in FIG. 3 and end view in FIG. 4. As can be seen in FIG. 3, the fixed end 25*f* of the flexible member 25 has a pair of apertures 45 through which the bolts 39 of the fixed mount 37 extend. As mentioned, the flexible member 25 is formed as a stack of laminations 27. Each of the laminations, and therefore the flexible member 25, has a length "a" and a width "b". The width "b" is for the most part determined by the amount of space available between phases of a multipole interrupter and electrical isolation considerations. The length "a" is effected by several factors including space available, but is most closely determined by the stroke of the moveable contact stem. The thickness "c" is established by the number of laminations 27 used and is determined as a function of the ampacity required for the flexible shunt and the dimension "b". The laminations 27 in the fixed end 25*f* and the moveable end 25*m* are interfaced to reduce the electrical resistance between laminations and thereby promote current sharing. This interface 47 may be implemented by joining the laminations in the fixed end 25*f* and moveable end 25*m* by a process such as pressure welding. Alternatively, the ends 25*f* and 25*m* are not joined and are interfaced by plating such as with silver plating or plating with another high conductivity material. The joint is then clamped such as with bolts. The laminations 27 are not joined in their intermediate sections 25*i* so that they remain independent and can individually flex and slide relative to one another during bending of the flexible member. Thus, the fixed end 25*f* has a length "d" and the moveable end 25*m* has a length "e" selected to provide the appropriate conductivity. As will be seen, the length "f" of the intermediate section 25*i* is an important dimension. Another important dimension is the length "g" between the centers of the aperture 33 in the moveable end and the apertures 45 in the fixed end 25*f*.

Returning to FIG. 1, it will be noted that in the installed condition, the distance "h" between the center line 49 of the moveable contact stem 15 and the center line 51 of the bolts 39 is shorter than the distance "g" between the centers of the aperture 33 which is aligned by the moveable mount 29 with the center line 49 and the centers of the apertures 45 forced into alignment with the center line 51. This results in the installed length "j" of the intermediate section 25*i* being shorter than the real length "f" of this section of the flexible shunt. This produces a slight bow 53 in the intermediate section 25*i* which is shown in FIG. 1 for illustration. The stroke 55 of the moveable contact stem 15, and therefore the moveable end 25*m* of the flexible member 25 along the linear path 17 has a dimension "k". The center of the fixed end 25*f* defines a neutral axis 57 which is substantially perpendicular to the linear path 17. The components are shown in FIG. 1 in a neutral position in which the moveable end 25*m* is centered on the neutral axis 57. In the exemplary embodiment the stroke 55 carries the moveable end 25*m* along the linear path 17 upward to a closed position of the separable contacts shown in phantom at 59 and downward to an open position shown in phantom at 61. It will be noted that the fixed mount 37 and the moveable mount 29 mount the respective ends of the flexible member 25 with the laminations 27 substantially parallel to the neutral axis 57 and therefore perpendicular to the linear path 17.

An important consideration of the invention is that the laminations 27 be very thin, less than about 0.002 inch (about 0.051 mm). A preferred thickness is no more than about 0.0015 inch (about 0.038 mm). A commonly available copper foil has a thickness of 0.0014 inch (about 0.0356 mm). This foil when used with silver plating resulted in a thickness of 0.0015 inch (about 0.038 mm). If the foil is too thin, it will not be durable, hence a foil should have a thickness of at least about 0.001 inch (about 0.0254 mm).

The number of laminations 27 in the flexible member 25 is a function of the ampacity required and the temperature rise limitations.

A very important design characteristic for proper operation of the flexible member 25 is the installed length, the dimension "j" in FIG. 1. If this installed length is too long, the flexible member will bind requiring high forces to move it and creating excessive stress leading to earlier failure. If the dimension "j" is too short compared to the dimension "g", the flexible member will exert high forces on its mountings creating excessive flexing of the foils and give unsatisfactory performance leading to early failure. This dimension "j" is related to the actual length "f" of the intermediate region 25*i* and the stroke "k". The installed length "j", or offset distance between the fixed and moveable ends of the flexible member 25, must be adequate so that there is sufficient length "f" to accommodate the full stroke "k". With the invention, the stroke "k" can be at least about one-third of the length "f" of the intermediate section 25*i*, and the exemplary embodiment achieved a stroke "k" which is at least about one-half of the length "f".

EXAMPLE

Tests were conducted on a flexible shunt in accordance with the invention with the following specifications:

1,250 amps continuous current

25 KA symmetrical for three seconds

63 KA peak 20 mm total motion (+/−10 mm from neutral axis)

must have low resistance and maintain low resistance, including joints must be economical to produce and use must not be deformed or damaged by high transient currents The width "b" of the flexible member 25 was set at 2.5 inch (63.5 mm) to accommodate a particular vacuum interrupter construction. A cross sectional area ("b"×"c") of 0.9 square inches (5.81 $cm^2$) resulted in a current density at a rated current of 1,250 amps of 1,390 amps per $in^2$ (215 $A/cm^2$). With the width "b" of 2.5 inch (63.5 mm) the thickness "c" is 0.36 inch (9.1 mm). Using 0.0015 foil (with plating), 240 laminations were stacked up.

The full length "a" of the laminations was 3.25 inch (8.255 cm), the intermediate length "f" was 1.5 inch (38.1 mm). Through experimentation and adjusting the length "h" between the center line of the moving contact stem 15 and the fixed mount 37, the distance "h" found to give the desirable behavior was 2.22 inch (56.4 mm). The aperture 33 in the moveable end 25*m* was 0.406 inch (10.31 mm) and the apertures 45 in the fixed end 25*f* were 0.328 inch (8.33 mm) in diameter. The flexible shunt was operated through over 20,000 cycles and was still in excellent condition. In addition, a 1250 Ampere Temperature Rise Test was very successful. We also performed momentary and 3 second tests which also were very successful. In all tests the flexible shunt performed admirably without problems. These tests demonstrated the thermal and physical capabilities of the flexible shunt since no overheating or distortion of the flexible shunt occurred.

For 630 amps continuous current and the other requirements listed above, the thickness "c" of the flexible member 25 would be 0.180 inch (4.6 mm).

Figure 5:
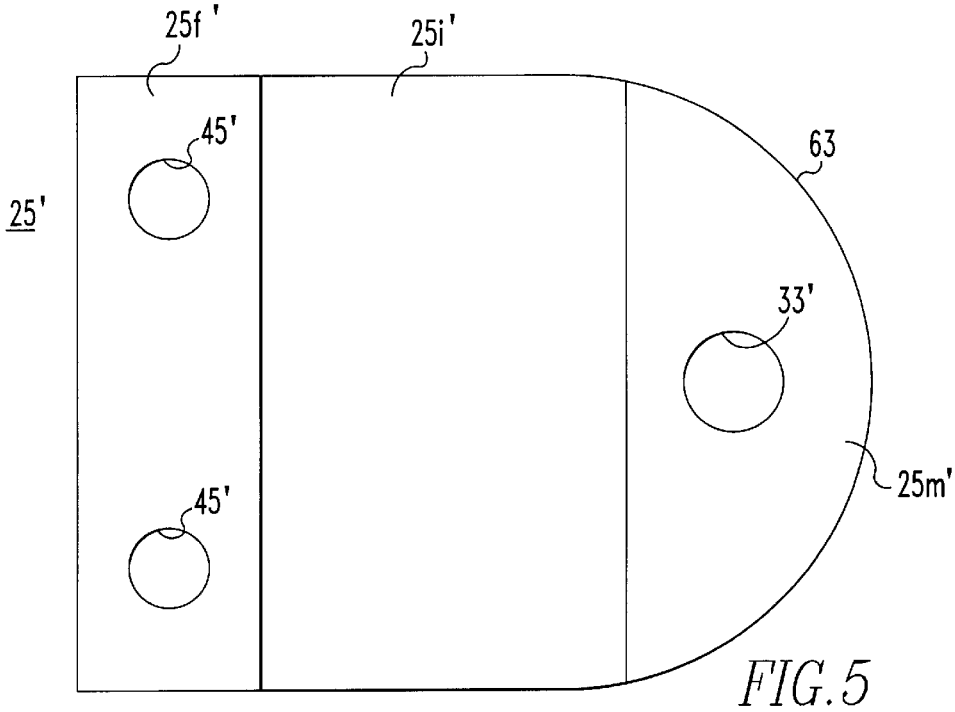
FIG. 5 is a plane view of an alternative form of the flexible member.

FIG. 5 illustrates an alternative configuration of the flexible member 25' in which the corners of the moveable end 25*m'* of the flexible member are removed by providing a circular peripheral edge 63. This does not affect the operating parameters discussed above in the connection with the configuration of FIG. 3, and it provides a more compact arrangement while eliminating the voltage stress points created by the square corners of the configuration of FIG. 3.

The invention provides a flexible shunt 25 which is much more compact than those currently available for similar current ratings. Specifically, it provides a much shorter shunt for the stroke. In addition, the forces required to operate the shunt between the open and closed positions of the circuit interrupter contacts are very low and may be considered generally negligible.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A flexible shunt for electrically connecting an electrical power switch moveable contact support member reciprocating along a linear path to a stationary conductor termination positioned laterally of said linear path, said flexible shunt comprising:

a flexible member comprising a stack of electrically conductive laminations having a fixed end, a moveable end and an intermediate section between said fixed end and said moveable end, said intermediate section having a predetermined length;

a moveable mount securing said moveable end of said flexible member to said moveable contact support member for movement therewith over a stroke extending along said linear path between a closed position at one end of said stroke and an open position at another end of said stroke; and a fixed mount securing said fixed end of said flexible member to said stationary conductor termination with said fixed end spaced from said moveable end along a neutral axis which is substantially perpendicular to said linear path by an off set distance which is less than said predetermined length of said intermediate section of said flexible member, said stroke being at least about one-third of said predetermined length of said intermediate section of said flexible member.

2. The flexible shunt of claim 1 wherein said stroke is at least about onehalf of said predetermined length of said intermediate section of said flexible member.

3. The flexible shunt of claim 1 wherein said fixed mount mounts said fixed end of said flexible member with said laminations extending substantially perpendicular to said linear path.

4. The flexible shunt of claim 1 wherein said moveable mount mounts said moveable end of said flexible member to said moveable contact support member with said laminations extending substantially perpendicular to said linear path.

5. The flexible shunt of claim 4 wherein said fixed mount mounts said fixed end of said flexible member with said laminations extending substantially perpendicular to said linear path.

6. The flexible shunt of claim 1 wherein said laminations in said fixed end and said moveable end of said flexible member are joined, but said laminations in said intermediate section of said flexible member are not joined.

7. The flexible shunt of claim 1 wherein said laminations at least at said fixed end and said moveable end of said flexible member are plated.

8. The flexible shunt of claim 1 wherein said laminations are no greater than about 0.002 inches (about 0.051 mm) thick.

9. The flexible shunt of claim 8 wherein said laminations are no more than about 0.0015 inches (about 0.038 mm) thick.

10. The flexible shunt of claim 1 wherein said stack of laminations comprises at least about one hundred laminations.

11. The flexible shunt of claim 10 wherein said stack of laminations comprises at least about two hundred laminations.

12. The flexible shunt of claim 11 wherein said laminations are not more than about 0.002 inches (about 0.051 mm).

13. The flexible shunt of claim 12 wherein said laminations are not more than about 0.0015 inches (about 0.038 mm).

14. The flexible shunt of claim 13 wherein said laminations are at least 0.001 inches (about 0.0254 mm) thick.

15. The flexible shunt of claim 1 wherein said moveable contact support member comprises a moveable contact stem of a vacuum interrupter.

16. The flexible shunt of claim 15 wherein said stroke of said moveable contact stem is at least about 0.6 inches (about 15 mm).

17. The flexible shunt of claim 16 wherein said stroke of said moveable contact stem is at least about 0.787 inches (about 20 mm).

18. The flexible shunt of claim 17 wherein said length of said intermediate section of said flexible member is no more than about 1.5 inches (about 38.1 mm).

19. The flexible shunt of claim 18 wherein said laminations are not more than about 0.002 (about 0.051 mm) thick.

20. The flexible shunt of claim 19 wherein said laminations are not more than about 0.0015 inches (about 0.038 mm) thick.

21. The flexible shunt of claim 20 wherein said stack of laminations comprises about at least one hundred laminations.

22. The flexible shunt of claim 21 wherein said stack of laminations comprises at least about two hundred laminations.

23. An electric power switch connected between first and second stationary conductors and comprising:

separable contacts including a fixed contact and a moveable contact;

a fixed contact support on which said fixed contact is mounted for connection to said first stationary conductor;

a movable contact support on which said moveable contact is carried;

an operating mechanism reciprocating said moveable contact support along a linear path to open and close said separable contacts; and a flexible shunt comprising:

a flexible member comprising a stack of electrically conductive laminations having a fixed end, a moveable end, and an intermediate section between said fixed end and said moveable end, said intermediate section having a predetermined length;

a moveable mount securing said moveable end of said flexible member to said moveable contact support member for movement therewith over a stroke extending along said linear path between a closed position at one end of said stroke and an open position at the other end of said stroke; and a fixed mount securing said fixed end of said flexible member to said second stationary conductor with said fixed end spaced from said moveable end along a neutral axis which is substantially perpendicular to said linear path by an offset distance which is less than said predetermined length of said intermediate section of said flexible member, said stroke being at least about one-third of said predetermined length of said intermediate section of said flexible member.

24. The electric power switch of claim 23 wherein said laminations in said fixed end and said moveable end of said flexible member are joined, but said laminations in said intermediate section of said flexible member are not joined.

25. The electric power switch of claim 23 wherein said laminations at least at said fixed end and said moveable end of said flexible member are plated.

26. The electric power switch of claim 23 wherein said laminations are no greater than about 0.002 inches (about 0.051 mm) thick.

27. The electric power switch of claim 26 wherein said stroke of said moveable contact stem is at least about 0.6 inches (about 15 mm).

28. The electric power switch of claim 27 wherein said length of said intermediate section of said flexible member is no more than about 1.5 inches (about 38.1 mm).

* * * * *